US006576606B2

(12) United States Patent
Richards, III et al.

(10) Patent No.: US 6,576,606 B2
(45) Date of Patent: Jun. 10, 2003

(54) HYDROPHILIC NON-YELLOWING ORGANOPOLYSILOXANE TEXTILE SOFTENER COMPOSITIONS

(75) Inventors: John H. Richards, III, Spartanburg, SC (US); Jesse E. Helvey, Simpsonville, SC (US)

(73) Assignee: Kelmar Industries, Inc., Duncan, SC (US)

( * ) Notice: Subject to any disclaimer, the term of this patent is extended or adjusted under 35 U.S.C. 154(b) by 211 days.

(21) Appl. No.: 09/844,978

(22) Filed: Apr. 27, 2001

(65) Prior Publication Data

US 2002/0193273 A1 Dec. 19, 2002

(51) Int. Cl.[7] ..... C11D 3/37
(52) U.S. Cl. ..... 510/475; 510/327
(58) Field of Search ..... 510/475, 327

(56) References Cited

U.S. PATENT DOCUMENTS

| | | | | |
|---|---|---|---|---|
| 2,929,829 A | | 3/1960 | Morehouse | |
| 3,440,261 A | | 4/1969 | Saam | |
| 3,956,353 A | | 5/1976 | Plueddemann | |
| 4,390,713 A | | 6/1983 | Martin | |
| 4,409,267 A | | 10/1983 | Ichinohe et al. | |
| 4,507,455 A | | 3/1985 | Tangney et al. | |
| 4,973,620 A | | 11/1990 | Ona et al. | |
| 4,978,363 A | | 12/1990 | Ona et al. | |
| 4,978,561 A | | 12/1990 | Cray et al. | |
| 5,039,738 A | | 8/1991 | Czech | |
| 5,100,991 A | | 3/1992 | Cray et al. | |
| 5,302,659 A | | 4/1994 | Bindl et al. | |
| 5,540,952 A | | 7/1996 | Canivenc et al. | |
| 5,593,611 A | * | 1/1997 | Czech | 252/8.63 |
| 5,707,434 A | * | 1/1998 | Halloran et al. | 106/287.11 |

OTHER PUBLICATIONS

Derwent Abstract Corresponding To EP 349753A.
Abstract and Equivalencies To JP 57/101076 Jun. 1982.

* cited by examiner

*Primary Examiner*—John Hardee
(74) *Attorney, Agent, or Firm*—Brooks & Kushman P.C.

(57) ABSTRACT

Acylated terminal aminoalkyl organopolysiloxane fluids exhibit improved color properties and wetting time properties while maintaining good hand, when used as textile softeners.

16 Claims, No Drawings

HYDROPHILIC NON-YELLOWING ORGANOPOLYSILOXANE TEXTILE SOFTENER COMPOSITIONS

BACKGROUND OF THE INVENTION

1. Field of the Invention

The present invention is directed to organopolysiloxane compositions useful as softeners for textile products, to a process for softening textile products with such compositions, and to the products thus treated.

2. Background Art

Textile "finishes" represent a large commercial market. Many types of such finishes are available, and are formulated with specific reference to their end use. For example, many fiber lubricant compositions are available which lower the coefficient of friction of fibers during processing. Other textile finishes are applied to yarns and woven textiles to make these products water repellent, while still further compositions are added to wovens and non-wovens to impart increased strength characteristics. The present application is not directed to finishes generally, but to a particular class of finishes known as "softeners".

Softeners are applied to textile products such as fibers, yarn, wovens or non-wovens, to impart a soft feel, or "hand". This increased softness is readily perceptible to the ultimate consumer, and thus softeners represent important items of commerce. To be commercially acceptable, softeners must exhibit several important characteristics following application to a textile substrate. The textile will desirably possess a soft hand; the textile must be readily wettable; and the softener must not cause yellowing of the product.

The above characteristics are often conflicting, and it is difficult to obtain all these properties in a given softener composition. For example, organopolysiloxane fluids such as polydimethylsiloxanes ("PDMS fluids") are known to provide some improvement in softness. However, these products must be emulsified with considerable quantities of surfactants, which leave a residue which can cause undesirable changes in color. Use of organic solvents such as white oils in lieu of water allows elimination of surfactants. Use of organic solvents is not desirable, however. Moreover, the treated fabrics tend to be hydrophobic, with long wetting times, and only modest improvement of hand is achieved.

In U.S. Pat. No. 4,247,592 it is proposed to employ aminoalkyl-functional polyorganosiloxanes as fabric softeners. Such products require somewhat less emulsifier, and can produce an outstanding pleasing, soft hand. However, fabrics treated with compositions containing aminofunctional PDMS fluids are prone to yellowing over time, believed to be caused by oxidation of the aminoalkyl groups by atmospheric oxygen or ozone. A variety of proposals have been made to eliminate the yellowing problem. However, the majority of these either result in only modest improvement, or do so at greatly increased cost. Modest improvement in yellowing at some sacrifice of hand is disclosed by U.S. Pat. No. 4,978,363, wherein fatty acid salts of amimoalkyl-substituted organopolysiloxane are employed.

Softeners have been proposed where piperidinyl or morpholinyl moieties have been substituted for the readily available aminoalkyl functionality. An example is U.S. Pat. No. 5,540,952. However, the synthesis of such compounds tends to be difficult and expensive.

U.S. Pat. No. 4,507,455 discloses softeners prepared by N-acylation of organopolysiloxanes with pendant aminoalkyleneaminoalkyl groups. While these acylated softeners show improvements in yellowing behavior, their softening characteristics are not ideal. Indeed, in U.S. Pat. No. 4,978,561 and commonly assigned U.S. Pat. No. 5,100,991, it is stated that such acylated amino-functional silicone fluids do not provide a particularly soft hand, but rather impart a harsh feel. The '561 and '991 patents disclose acylation of pendant aminoalkyl and polyaminopolyalkylene organopolysiloxanes with lactones to produce N-(hydroxyalkyl)acylated products.

Neat N-acylated amino-functional silicones and silanes have been disclosed as being useful for coupling agents in fiber reinforced composites. In such applications, as typified by U.S. Pat. Nos. 2,929,829 and 3,440,261, neat silicone or silicone dissolved in volatile organic solvent is applied to glass fiber or carbon fiber reinforcement, glass microballoons, etc., prior to impregnating with thermosetting resin. The cured composites are said to exhibit greater strength characteristics due to increased adhesion between reinforcement and polymer matrix.

In U.S. Pat. No. 5,302,659 is disclosed a novel method of preparing N-acylated, aminoalkyl-functional organopolysiloxanes useful as softeners. In this process, organopolysiloxanes having hydroxyl-(silanol) or alkoxy-functional end groups and pendant aminoalkyl groups are reacted with an acyclic carboxylic acid anhydride or a cyclic dicarboxylic acid anhydride to form, in the former case, an N-acylated product having an

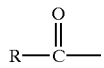

acyl group where R is alkyl, or in the latter case, a

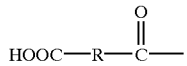

group where R is alkylene or alkenylene. The N-acylation takes place in the dispersed phase, but requires a large amount of anhydride. Moreover, the products exhibit only modest improvement in hand over untreated textile, and a longer than desired wetting time.

It would be desirable to provide a softener composition which provides excellent softening, which is readily wettable, and which resists yellowing. Such a softener should also be manufacturable at a cost which is commercially viable.

SUMMARY OF THE INVENTION

The present invention pertains to softeners based on acylated aminoalkyl-functional organopolysiloxanes which are readily emulsifiable, and which produce fabrics with soft hand, rapid wettability, and high yellowing resistance. The softeners are amides formed by acylating α,ω-aminoalkyl-functional organopolysiloxane fluids.

DETAILED DESCRIPTION OF THE PREFERRED EMBODIMENTS

The subject invention softeners are prepared by N-acylating (hereinafter, "acylating") α,ω-aminoalkyl-functional organopolysiloxane fluids. The degree of acylation may vary, but is preferably at least 50 mol percent based on moles of primary and/or secondary amino groups present, more preferably at least 75 mol percent, and yet more preferably 90 mol percent or more. Most preferably, all amino groups are acylated. The acylation produces amide groups, and may, in addition, produce a limited, minor amount of imide groups in certain instances. Imide groups are preferably absent.

The α,ω-aminoalkyl-functional organopolysiloxanes are preferably of the formula $$XR_2SiO—(XRSiO)_m—(R_2SiO)_n—SiR_2X$$

where X is an aminoalkyl group as defined hereafter, R is a hydrocarbon(oxy) group, and n and m are such that the fluid has a neat viscosity at room temperature from 1 cP to 100,000 cP. In the above formula, and in the claims, it does not depart from the spirit of the invention to include a minor quantity of $RSiO_{3/2}$, $XSiO_{3/2}$, or $SiO_{4/2}$ moieties, so long as the product is substantially linear, i.e., remains a liquid at room temperature. The organopolysiloxane may also contain interspersed linking groups, preferably alkylene groups such as ethylene, hexylene, etc., or polyoxyalkylene residues bonded to Si either at an oxygen, or preferably at carbon of the polyoxyalkylene moiety.

In the above formula, R is preferably a $C_{1-20}$ alkyl group, more preferably a $C_{1-8}$ alkyl group or phenyl group, yet more preferably a methyl, ethyl, or phenyl group, and most preferably, methyl. In some formulations, some R may be alkoxy, preferably $C_{1-8}$ alkoxy, more preferably $C_{1-4}$ alkoxy, and most preferably methoxy or ethoxy, hydroxyl (—OH), substituted alkyl, e.g., haloalkyl, preferably chloroalkyl or fluoroalkyl. The nature of the various R groups is not overly critical, provided the advantageous properties of the softener are not affected thereby. A limited number of R may be polyoxyalkylene, i.e., pendant as opposed to "in chain" polyoxyalkylene groups.

Examples of preferred amino-functional radicals "X" are radicals of the general formula (II)

$$—R^1—[NR^2(CH_2)_a]_bNHR^2 \quad (II)$$

and ammonium salts thereof which can be prepared by reaction with mineral or carboxylic acids, in which $R^1$ is preferably a divalent $C_1$- to $C_{18}$-hydrocarbon radical, $R^2$ is preferably a hydrogen atom or an optionally fluorine-, chlorine- or bromine-substituted $C_1$- to $C_{18}$-hydrocarbon radical, a has the values 2, 3, 4, 5 or 6 and b has the values 0, 1, 2, 3 or 4.

Examples of the divalent $C_1$- to $C_{18}$-hydrocarbon radicals $R^1$ are preferably unsaturated straight- or branched-chain or cyclic alkylene radicals, such as the methylene and ethylene radical, as well as propylene, butylene, pentylene, hexylene, 2-methylpropylene, cyclohexylene and octadecylene radicals, or unsaturated alkylene radicals or arylene radicals, such as the hexenylene radical and phenylene radicals, the n-propylene radical and the 2-methylpropylene radical being particularly preferred.

Examples of the hydrocarbon radicals $R^2$ are preferably the examples mentioned for R. Examples of halogen-substituted hydrocarbon radicals $R^2$ are haloalkyl radicals, such as the 3,3,3-trifluoro-n-propyl radical, the 2,2,2,2',2',2'-hexafluoroisopropyl radical and the heptafluoroisopropyl radical, and haloaryl radicals, such as the o-, m- and p-chlorophenyl radical. In the above general formula (II), preferably, $R^1$ is a divalent $C_2$- to $C_6$-hydrocarbon radical, $R^2$ is a hydrogen atom or a methyl or cyclohexyl radical, a has the value 2 or 3 and b has the value 0 or 1.

The aminoalkyl-functional organopolysiloxanes are commercially available or may be made by standard synthetic methods. For example, aminoalkyl-functionality can be introduced into silanol-terminated PDMS, e.g., $HO—(Si(CH_3)_2—O)_n—H$ by reaction with an aminoalkylalkoxysilane. Reaction of α,ω-silanol-terminated PDMS with aminoethylaminopropyldimethylmethoxysilane creates an α,ω-aminoethylaminopropyl-terminated PDMS. Reaction with both a mono-functional silane, for example, such a mono-functional silane and aminoethylaminopropylmethyldimethhoxysilane, a difunctional silane, creates a product with both terminal and pendant aminoethylaminopropyl groups. In addition to these synthetic methods, aminoalkyl-functional silicones may be made by equillibrating aminoalkyl-functional silicones of different molecular weights, by reaction of unsaturated amino-functional hydrocarbons with Si—H functional silicones, and other methods known to those skilled in the art.

Acylation of the aminoalkyl-functional silicones requires an acylating agent. While carboxylic acids such as acetic and propionic acids could theoretically serve as acylating agents with removal of water, such reactions are time consuming and energy intensive. Water must be removed to induce acylation. In the absence of removal of water, salt formation rather than acylation occurs. Use of acylating agents such as acylhalides is more rapid. The byproduct hydrogen halides may form salts with any remaining amino groups. It is preferable, however, to acylate employing carboxylic acid anhydrides such as acetic anhydride. In such cases, the byproducts of the reaction are carboxylic acids, which often assist in emulsifying the acylated product.

The acylation may take place neat or in suitable solvent. When carboxylic acids are used for acylation, toluene, xylene, or another organic solvent which forms an azeotrope with water liberated in the reaction may be used. In the case of acyl chlorides, similar solvents may be used, or solvents such as glyme, diglyme, and similar hydroxyethers or diethers may be used. Diethylene glycol bis(n-butyl ether) is a preferred solvent, particularly with acylation by carboxylic acid anhydrides.

The amount of acylating agent should be sufficient to acylate at least 25 mol percent of the acylatable amino nitrogens, preferably at least 33 mol percent, more preferably at least 50 mol percent. Most preferably the degree of acylation is in the range of 50 mol percent to 100 mol percent, most preferably in the range of 60 mol percent to 100 mol percent, and most preferably in the range of 75 mol percent to 90 mol percent or higher. While N-acylation is the expected reaction, particularly at low equivalent ratios of acylating agent to amino group, it is also possible to form a minor amount of imide groups, although this is not the preferred reaction. Imide formation is more likely when employing cyclic anhydrides under "forcing" conditions, i.e., with concurrent removal of water. Minor amounts i.e., less than 50 mol percent of total acylating agent, more preferably less than 30 mol percent, and most preferably less than 15 mol percent, may comprise cyclic anhydrides, preferably saturated anhydrides such as succinic anhydride. Ratios of anhydride to amino nitrogen in excess of 1:4 are preferred, more preferably in excess of 0.5:1, and most preferably in the range of 0.8–1.2:1.

Following acylation, the acylated product may, if desired, be washed with water to remove excess acylating agent and byproducts. For example, when employing acyl chlorides, byproduct HCl may be removed, or in the case of dicarboxylic acid anhydrides, byproduct carboxylic acid may be removed. Removal efficiency may be enhanced by use of basic aqueous washes, for example aqueous sodium hydroxide, sodium carbonate, or sodium bicarbonate. Washing of the product is not preferred.

The desired product will contain amide groups where the starting material contained amino groups. The amide groups preferably have the formula

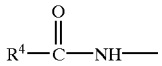

in the case of primary amino groups, and

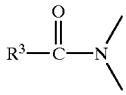

in the case of secondary amino groups. In these formulae, $R^4$ is an optionally substituted $C_{1-20}$ hydrocarbon group, more preferably a $C_{1-4}$ hydrocarbon group. Suitable substituents are any which do not interfere with the preparation of the acylated product or which render the acylated product unstable. Examples are hydroxyl, cyano, halo, preferably chloro or fluoro, carboxylic acid, and the like. Most preferably, $R^4$ is methyl or ethyl. $R^4$ moieties containing carboxylic acid group substituents may be prepared by employing a cyclic anhydride. For example, use of succinic anhydride will generate $—(CH_2)_2—COOH$ groups in the absence of imidization, while reaction with a cyclic lactone will generate a hydroxyalkyl $R^4$ group. These groups are not preferred, however.

Thus, the preferred acylated aminoalkyl-functional silicones are those of the formula

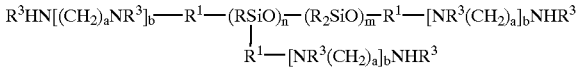

where R, $R^1$, and $R^2$ have the meanings given heretofore, and $R^3$ is H or

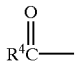

and at least 25 mol percent of $R^3$ are

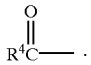

Preferably, the acylated products or the present invention are those of the formula

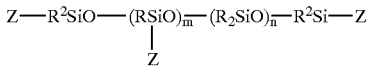

where R and $R^2$ are defined as before, and are preferably methyl, and Z is an acylated aminoalkyl group

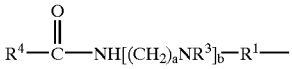

where $R^3$ is $R^2$ or

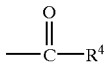

where $R^4$ is preferably $C_{1-4}$ alkyl, more preferably ethyl or methyl, and most preferably methyl, a is 2–6, preferably 0 or 1 and more preferably 1, and $R^1$ is an ethylene or propylenediradical, i.e., $—CH_2CH_2—$ or $—CH_2CH_2CH_2—$, m is 0 to 20, and n is 10 to 1000.

Most preferably, the acylated organopolysiloxanes of the subject invention are those of the formula

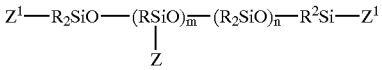

where $Z^1$ is selected from the group consisting of

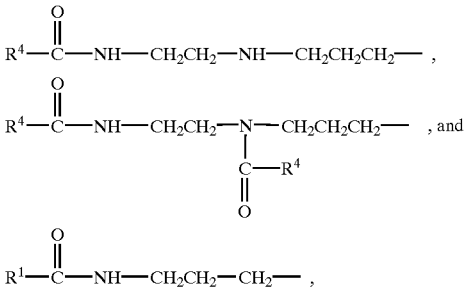

and salts thereof. The salts are formed by reaction of an acid, for example an acid liberated during acylation, with one or more nitrogen atoms. More preferably, the acylated products of the subject invention are polydhnethylsiloxanes having terminal aminopropyl-, aminoethylaminopropyl-, N-acylaminopropyl-, or N-acylaminoethylaminopropyldimethylsilyl groups, and optionally aminopropyl-, aminoethylaminopropyl-, N-acylaminopropyl-, or N-acylaminoethylaminopropyl-methylsiloxy units (pendant aminoalkyl or N-acylaminoalkyl groups). By the term "N-acyl" as it modifies polyalkylenepolyamines such as aminoethylaminopropyl groups is meant that one or more of the nitrogens are acylated. It should be noted that the various siloxy groups, i.e. those with hydrocarbon, hydrocarbonoxy, or aminoalkyl-substituents, may be positioned in any order in the organopolysiloxane.

Following preparation of the acylated product, and optional purification, the resultant oil is emulsified into water. The solids content (by "solids here is meant the active ingredient acylated product only) may range from as little as 5 weight percent based on total emulsion weight, to "concentrates" having as much 50%, 60%, or 70% solids. However, it is preferably to produce working emulsions which may be used as delivered, or with only moderate dilution. Some manufactures may choose to add proprietary additives to the final emulsion or concentrate, for example mildewcides, bacteriostats, antistatic agents, or the like. Alternatively, these may be added following or during formulation of the emulsion. Most preferably, the emulsions contain from 10% to 40% solids, more preferably 15% to 30%. End use emulsions containing 15% to 25% solids are preferred.

The acylated amino-alkyl-functional organopolysiloxanes may be emulsified with known surfactants, including anionic, non-ionic, cationic, amphopteric, and the like.

Suitable anionic emulsifiers are, in particular:

1. Alkyl sulfates, especially those which have a chain length of from 8 to 18 C atoms, and alkyl ether sulfates which have 8 to 18 C atoms in the hydrophobic radical and 1 to 40 ethylene oxide (EO) or propylene oxide (PO) units.

2. Sulfonates, in particular alkylsulfonates having from 8 to 18 C atoms, alkylarylsulfonates having from 8 to 18 C atoms, taurides and esters and half-esters of sulfosuccinic acid with monohydric alcohols or alkylphenols having from 4 to 15 C atoms; in which the alcohols or alkylphenols can optionally be ethoxylated with from 1 to 40 EO units.

3. Alkali metal salts and ammonium salts of carboxylic acids having from 8 to 20 C atoms in the alkyl, aryl, alkaryl or aralkyl radical.

4. Phosphoric acid partial esters and their alkali metal salts and ammonium salts, and in particular alkyl phosphates and alkaryl phosphates having from 8 to 20 C atoms in the organic radical and alkyl ether-phosphates and alkaryl ether-phosphates having from 8 to 20 C atoms in the alkyl or alkaryl radical and from 1 to 40 EO units.

Suitable nonionic emulsifiers are, in particular:

1. Alkyl polyglycol ethers, preferably those having from 8 to 40 EO units and alkyl radicals of from 8 to 20 C atoms.

2. Alkylaryl polyglycol ethers, preferably those having from 8 to 40 EO units and from 8 to 20 C atoms in the alkyl and aryl radicals.

3. Ethylene oxide/propylene oxide (EO/PO) block copolymers, preferably those having from 8 to 40 EO and PO units.

4. Fatty acids having from 6 to 24 C atoms.

5. Natural substances and their derivatives, such as lecithin, lanolin, saponin and cellulose; cellulose alkyl ethers and carboxyalkylcelluloses, in which the alkyl groups each have up to 4 carbon atoms.

6. Straight-chain organo(poly)siloxanes containing polar groups, and in particular those containing alkoxy groups having up to 24 C atoms and/or up to 40 EP and/or PO groups.

Suitable cationic emulsifiers are, in particular:

1. Salts of primary, secondary and tertiary fatty amines having from 8 to 24 C atoms with acetic acid, sulfuric acid, hydrocholoric acid and phosphoric acids.

2. Quaternary alkylbenzeneammonium salts, in particular those in which the alkyl group has from 8 to 24 C atoms, and in particular the halides, sulfates, phosphates and acetates.

3. Alkylpyridinium, alkylimidazolinium and alkyloxazolinium salts and in particular those in which the alkyl chain has up to 18 C atoms, especially the halides, sulfates, phosphates and acetates.

Additional suitable emulsifiers which may be employed in the preparation of the emulsions are fatty acid polyglycol esters, polyethoxylated fatty acid glycerides and sorbitan esters, alkyl polyglycosides, fatty acid alkylolamides, alkyl ether-carboxylic acids, alkaryl ether-carboxylic acids, ethoxylated quaternary ammonium salts, amine oxides, betaines, sulfobetaines and sulfosuccinates.

Further emulsifiers include alkyl polyglycosides which are described in EP-A 418 479, of the general formula;

$$R''—O—Z_o,$$

in which

R" is preferably a linear or branched, saturated or unsaturated alkyl radical having on average 8 to 24 carbon atoms, preferably 8 to 16 carbon atoms, and $Z_o$ is preferably an oligoglycoside radical having on average o=1 to 10, preferably 1 to 5 hexose or pentose units, or mixtures thereof.

Alkyl polyglycosides with a saturated alkyl radical having on average 8 to 14 carbon atoms and an average degree of glycosidation n of between 1.1 and 3 are particularly preferred.

Cosurfactants may be used. Cosurfactants include water miscible lower alcohols, glycols, ketones and ethers, more generally polar organic compounds of moderate molecular weight. Examples of particularly suitable cosurfactants are, preferably, 1-butanol, 2-butanol, 2-methyl-2-propanol, 1-pentanol, 2-pentanol, 3-pentanol, 1-hexanol, 2-hexanol, 3-hexanol, 1-heptanol, 2-heptanol, 3-heptanol, 4-heptanol, 1-octanol, 2-octanol, 3-octanol and 4-octanol; diethylene glycol monomethyl, monoethyl and monobutyl ethers; diethylene glycol dimethyl and diethyl ethers; 1-aminobutane, 2-aminobutane, 2-amino-2-methylpropane, 1-aminopentane, 2-aminopentane, 1-aminohexane, 1-aminoheptane and 1-aminooctane; ethyl, propyl, isopropyl, butyl, isobutyl, pentyl, isopentyl and hexyl acetates; methyl, ethyl and tert-butyl propionates; methyl, ethyl, propyl and butyl butyrates; 2-butanone, 2-pentanone, 3-pentanone, 4-methyl-2-pentanone, 2-hexanone, 3-hexanone, 2-heptanone, 3-heptanone, 4-heptanone, 5-methyl-3-heptanone, 2-octanone and 3-octanone.

Examples of preferred cosurfactants are 1-alkanols of the examples listed above with $C_5$ to $C_8$ chains, diethylene glycol monobutyl ethers, diethylene glycol dimethyl and diethylene glycol diethyl ether, propyl, butyl and pentyl acetates, and 2-pentanone.

Particularly preferred cosurfactants are 1-pentanol, 1-hexanol and 1-octanol, diethylene glycol monobutyl ether, diethylene glycol dimethyl ether and butyl acetate.

In addition to organopolysiloxane (a), alkyl polyglycosides (b), water and, where appropriate, cosurfactant, the emulsions employed according to the invention can also comprise additives. These are, in particular, bactericides, fungicides, algicides, microbicides, fragrances, corrosion inhibitors, dyes, pigments, thickeners and fillers. The emulsions according to the invention preferably comprise additives each in amounts of 0 to 1 percent by weight, in particular 0 to 0.2 percent by weight, in each case based on the total weight of the finished emulsion.

All the components of the emulsion employed according to the invention can be mixed in any desired sequence using emulsifying apparatuses or by stirring together without exerting high shear forces. For example a homogeneous mixture of organopolysiloxane (a), alkyl polyglycosides (b) and water may first be prepared and the cosurfactants and additives, if employed, stirred into this mixture without exerting high shear forces.

The pressure exerted on the particular components or mixtures is preferably atmospheric pressure, increased, where appropriate, by the action of the mixing apparatus while the correspondingly prevailing temperature is preferably the room temperature, increased, where appropriate, by the action of the mixing apparatus.

The preparation of the acylated α,ω-aminoalkyl-terminated organopolysiloxanes is preferably accomplished employing an aliphatic, saturated carboxylic acid anhydride, most preferably because of economics, acetic anhydride. The anhydride may be added to the amino-functional fluid neat, or with either component dissolved in solvent. The addition should preferably take place at a rate such that high temperature excursions are avoided, as the reaction is quite exothermic. The actual addition rate will depend in large measure on the cooling and agitation capabilities of the reaction vessel. Continuous preparation may also be accomplished in tubular reactors, adding the ingredients at the inlet only, or along the length of the reactor.

The α,ω-aminoalkyl-functional organopolysiloxanes may be made by any method known to the art, including equilibration of lower molecular weight products such as 1,2-bis (aminoethyllaminopropyl)tetramethyldisiloxane. However, a convenient method of synthesis is condensation of an α,ω-disilanol-functional fluid with an aminoalkyldiorganoalkoxysilane such as aminoethylaminopropyldimethylmethoxysilane. The starting silanol fluid is preferably an α,ω-dihy-terminated polydimethylsiloxane.

If pendant aminoalkyl groups are desired, the starting silanol-terminated fluids may have pendant aminoalkyl groups, as disclosed in U.S. Pat. No. 5,302,659, but of higher molecular weight than the fluids used in that disclosure. These fluids are then reacted with the aminoalkylmethoxysilane. Alternatively, a lower molecular weight silanol-terminated fluid may be employed and reacted sequentially or concurrently with an aminoalkyl-substituted monoalkoxysilane and an aminoalkyl-substituted dialkoxysilane. In all cases, the reaction is continued until the viscosity of the product stabilizes, indicating that the reaction is complete. Alternative methods of determining degree of completion may also be used. It must be mentioned also, that incompletely reacted products, i.e., those containing minor amounts if alkoxy or silanol functionality are also useful, and within the scope of the invention unless otherwise indicated. Equilibration of the various species is accomplished by addition of common equilibration catalysts such as sodium or potassium hydroxide or phosphonitrilic cholorides.

The reaction of the alkoxysilane with silanol-terminated fluid preferably takes place at elevated temperature, for example above 60° C., and most preferably in the range of 80–120° C. If the temperature is excessive, return of silane to the reaction vessel by reflux may be desirable. The reaction may take place in air, or under a nitrogen blanket. Modest agitation is preferred.

Following preparation, the product is emulsified by standard techniques. Any conventional emulsification technique may be used, including preparation of invert emulsion "greases" followed by stepwise dilution and inversion into oil-in-water emulsions. The products may also be dissolved in organic solvent, dispersed, and the solvent removed by stripping or by distillation.

The subject invention may be illustrated by the following examples, which are not to be construed as limiting the scope of the invention in any way. All parts are parts by weight unless indicated otherwise.

EXAMPLES 1 AND 2 AND COMPARATIVE EXAMPLES

C1 AND C2 Acylated Softener Synthesis

EXAMPLE 1

An acylated aminoalkyl-functional fluid was prepared by condensing/equillibrating 87.10 parts of an α,ω-dihydroxy-terminated polydimethylsiloxane containing an average of approximately 43 siloxy moieties, 0.48 parts aminoethylaminopropyldimethylmethoxysilane, and 4.29 parts aminoethylaminopropylmethyldimethoxysilane, with the aid of 0.10 parts 45% by weight aqueous KOH in an open stainless steel reaction kettle. The mixture was heated to 95° C. and held at this temperature with stirring until the viscosity growth stabilized. The mixture, containing a polydimethylsiloxane with both terminal and pendant aminoethylaminopropyl groups, was cooled to room temperature, and 3.34 parts diethylene glycol bis(n-butylether) (DOWANOL® DB) was added. To the resulting solution, 4.69 parts acetic anhydride was added slowly with stirring while not allowing the temperature to rise beyond 85° C.

COMPARATIVE EXAMPLE C1

The procedure of Example 1 was followed, except that no aminoethylaminopropyldimethylmethoxysilane was employed as a chain terminator: As a result, an α,ω-bis (hydroxydimethylsilyl)-terminated polydimethylsiloxane with only pendant aminoethylaminopropyl groups was formed. The charges are summarized in Table 1. This product is then acylated as in Example 1.

EXAMPLE 2

The procedure of Example 1 was followed, but the degree of acylation reduced from 1:1 based on amino nitrogen atoms to 0.5:1. An α,ω-bis (aminoethylaminopropyldimethylsilyl)-terminated polydimethylsiloxane containing pendant aminoethylaminopropyl groups, and containing both acylated and non-acylated amino groups was produced.

COMPARATIVE EXAMPLE 2

A trimethylsilyl-terminated polydimethylsiloxane containing pendant aminoethylaminopropyl groups was produced by the procedure of Example 1, but trimethylmethoxysilane replaced the aminoethylaminopropyldimethylmethoxysilane or an approximately equimolar basis. The product was acylated as in Example 1.

EXAMPLE 3

A polydimethylsiloxane fluid with no pendant aminoalkyl groups, but terminated by aminoethylaminopropyl groups was prepared by the process of claim 1, except that no aminoethylaminopropylmethyldimethoxysilane was employed. The product is of lower average molecular weight than the pendant aminoethylaminopropyl products, and would be expected to produce somewhat less softening.

TABLE 1[1]

| Example: | 1 | C1 | 2 | C2 | 3 |
|---|---|---|---|---|---|
| OH-PDMS[2] | 87.1 | 87.1 | 89.2 | 86.15 | 87.1 |
| AEAP-M[3] | 0.48 | 0 | 0.49 | 0 | 4.77 |
| AEAP-D[4] | 4.29 | 4.77 | 4.39 | 5.00 | 0 |
| Acetic Anhydride | 4.69 | 4.69 | 2.4 | 5.00 | 4.70 |
| Type of Terminal Groups | AEAP[5] | —OH | AEAP | $(CH_3)_3Si$ | AEAP |
| Type of Pendant Groups | AEAP | AEAP | AEAP | AEAP | NONE |

[1]Amounts in parts by weight.
[2]OH-terminated polydimethylsiloxane fluid, CT-101 from Wacker Silicones, Adrian, MI.
[3]Aminoethylaminopropyldimethylmethoxysilane (Monofunctional), SLM 50991, Wacker Silicones.
[4]Aminoethylaminopropylmethyldimethoxy silane (Difunctional), GF-95, Wacker Silicones.
[5]Aminoethylaminopropyl.

Softening And Color Characteristics

Softener emulsions containing about 18.5% solids (silicone fluid) were prepared by blending together 3.72 parts of cosurfactant dipropylene glycol dimethylether and 18.59 parts of softener fluid, in 13.02 parts of an aqueous surfactant blend containing 5.58 weight percent of a 6 mol ethoxylate of tridecyl alcohol, 3.72 weight percent Tergitol® 15-S-7, and 3.72 weight percent polyethylene glycol 400 ("PEG-400"). Water to make 100 parts was added in at least two increments. A stable emulsion resulted.

Test emulsions of the subject invention acylated aminofluids having α,ω-aminoalkyl terminal groups and comparative fluids were tested for hand (softness), wetting time, and Δ whiteness index (change in whiteness). The test procedures were as follows: Conditioning Textiles for Testing, ASTM Method D-1776-79; Absorbency of Bleached Textiles, AATCC Method 79-1992. Softness evaluation was performed by a 10 member hand panel consisting of 5 male and 5 female evaluators. Samples were ranked from softest to harshest. The change in whiteness index (degree of yellowing, increasingly negative values are more yellow) was determined using a ColorFlex calorimeter by Hunterlab, by measuring the difference between the whiteness index of treated samples and untreated samples.

Also tested were a commercial, premium fluid containing pendant aminoethylaminopropyl acylated groups at a mol ratio of 0.5:1 based on amino nitrogens, KELMAR AF-2130, and a commercial water-soluble polyalkoxy silicone fluid, and WETSOFT® 200E (product of WETSOFT® CTW). In addition, both acylated, pendant aminoalkyl-functional hydroxy-terminal fluid (Comparative Example C1) and acylated, pendant aminoalkyl-functional trimethylsilyl-terminal fluid (Comparative Example C2) were tested as well. The test compositions were padded onto 100% cotton terry. The dry pick-up of the amino-functional fluid is approximately 0.67 weight percent, 4% by weight based on the weight of the bath, 90% wet pick-up. The bath contained 30% total solids, ca. 18.6% of amino-functional fluid. The results are presented in Table 2.

TABLE 2

| Softener | Pendant Aminoalkyl Functionality | Terminal Group | Acylated? | Hand Rank | Wetting Time, Seconds | Δ Whiteness Index |
|---|---|---|---|---|---|---|
| 1 | AEAP | AEAP | Yes | 2 | 3 | +0.63 |
| C1 | AEAP | —OH | Yes | 3 | 8 | −0.35 |
| 3 | None | AEAP | Yes | 4 | 0 (instantaneous) | +1.96 |
| C2 | AEAP | $(CH_3)_3$ | Yes | 2 | 8.5 | +0.12 |
| AF-2130 | AEAO | -OH | Yes | 1 | 49 | −8.7 |
| Wetsoft ® 200E | None | $(CH_3)_3$ | No | 5 | 0 (instantaneous) | −0.06 |

The application examples illustrate some of the tradeoffs encountered with softeners. The best softener in terms of hand is, as expected, a premium, acylated amino-functional fluid, Kelmar AF-2130. However, the wetting time of cotton terry treated with this softener is very long, 49 seconds, and a considerable amount of yellowing is evidenced by the large negative change in whiteness. Wetsoft® 200, another commercial softener, exhibited almost no yellowing (−0.06), had excellent, instantaneous wetting, but produced the least pleasing hand.

Polydimethylsiloxane fluids with acylated pendant aminoethylaminopropyl groups, but with hydroxyl (dimethylsilanol) or trimethylsilyl terminal groups produced intermediate hand, and only slight yellowing, but still exhibited longer than desirable wetting times.

The acylated aminoalkyl-terminated fluid of Example 1 exhibit by far the best overall performance, with very good hand, almost that produced by the amino-fluid, no yellowing (the terry actually became whiter), and a low wetting time. The Example 3 fluid, containing no pendant aminoalkyl groups but being of lower molecular weight, exhibited instantaneous wetting time and yet more increased whiteness, but with less hand, although still better hand than the commercial product Wetsoft 200E. It is expected that higher molecular weight versions of the Example 3 polymer would exhibit increased softness while maintaining the wetting characteristics and whiteness properties of the Example 1 fluid. The terms "a" and "an" when used in the claims, mean "one or more" unless clearly indicated otherwise.

Having now fully described the invention, it will be apparent to one of ordinary skill in the art that many changes and modifications can be made thereto without departing from the spirit or scope of the invention as set forth herein.

What is claimed is:

1. An aqueous organopolysiloxane emulsion useful as a softener for textile products, said emulsion, comprising:

a) an N-acylated, α,ω-aminoalkyl-functional organopolysiloxane fluid in an amount of from 5% to 70% weight based on the weight of the emulsion;

b) optionally a cosurfactant;

c) an amount of one or more surfactants effective to emulsify said fluid a) to form a stable emulsion; and d) water.

2. The emulsion of claim 1, wherein said organopolysiloxane fluid further comprises pendant aminoalkyl groups.

3. The emulsion of claim 1 wherein said aminoalkyl groups are selected from those of the general formula $$—R^1—[NR^2(CH_2)_a]_bNHR^2 \quad (II)$$

and ammonium salts thereof which can be prepared by reaction with mineral or carboxylic acids, in which $R^1$ is a divalent $C_1$- to $C_{18}$-hydrocarbon radical, $R^2$ is a hydrogen atom or an optionally fluorine-, chlorine- or bromine-substituted $C_1$- to $C_{18}$-hydrocarbon radical, a has the values 2, 3, 4, 5 or 6 and b has the values 0, 1, 2, 3 or 4.

4. The emulsion of claim 2 wherein said aminoalkyl groups are selected from those of the general formula $$—R^1—[NR^2(CH_2)_a]_bNHR^2 \quad (II)$$

and ammonium salts thereof which can be prepared by reaction with mineral or carboxylic acids, in which $R^1$ is a divalent $C_1$- to $C_{18}$-hydrocarbon radical, $R^2$ is a hydrogen atom or an optionally fluorine-, chlorine- or bromine-substituted $C_1$- to $C_{18}$-hydrocarbon radical, a has the values 2, 3, 4, 5 or 6 and b has the values 0, 1, 2, 3 or 4.

5. The emulsion of claim 1, wherein said N-acylation comprises N-acetyl groups.

6. The emulsion of claim 2, wherein said N-acylation comprises N-acetyl groups.

7. The emulsion of claim 1, wherein said fluid comprises an organopolysiloxane of the formula:

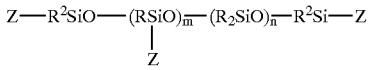

where R is selected from the group consisting of optionally substituted $C_{1-20}$ alkyl groups, a phenyl group, $C_{1-8}$ alkoxy, hydroxyl (—OH), and polyoxyalkylene $R^2$ is a hydrogen atom or an optionally fluorine-, chlorine- or bromine-substituted $C_1$- to $C_{18}$-hydrocarbon radical, Z is an acylated aminoalkyl group

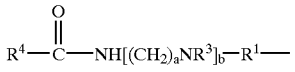

where $R^3$ is $R^2$ or

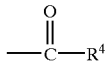

where $R^4$ is $C_{1-4}$ alkyl, a is 2–6, b is 0 or 1, and $R^1$ is a hydrocarbonoxy diradical, m is 0 to 20 and n is 10 to 1000, and wherein the m and n siloxy groups may be located in any order in the organopolysiloxane.

8. The emulsion of claim 7, wherein $R^4$ is methyl, $[(CH_2)_aNR^3]_b$ is $—(CH_2)_2NR^3—$, $R^1$ is $—(CH_2)_3-$, and

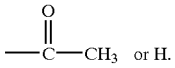

9. The emulsion of claim 1, wherein m is 0.

10. A process for softening a textile product said process comprising, contacting said textile product with an effective softening amount of the emulsion of claim 1.

11. A process for softening a textile product said process comprising, contacting said textile product with an effective softening amount of the emulsion of claim 2.

12. A process for softening a textile product said process comprising, contacting said textile product with an effective softening amount of the emulsion of claim 3.

13. A process for softening a textile product said process comprising, contacting said textile product with an effective softening amount of the emulsion of claim 4.

14. A process for softening a textile product said process comprising, contacting said textile product with an effective softening amount of the emulsion of claim 5.

15. A process for softening a textile product said process comprising, contacting said textile product with an effective softening amount of the emulsion of claim 6.

16. A process for softening a textile product said process comprising, contacting said textile product with an effective softening amount of the emulsion of claim 7.

* * * * *

UNITED STATES PATENT AND TRADEMARK OFFICE

CERTIFICATE OF CORRECTION

PATENT NO. : 6,576,606 B2 
DATED : June 10, 2003
INVENTOR(S) : John H. Richards, III et al.

It is certified that error appears in the above-identified patent and that said Letters Patent is hereby corrected as shown below:

Column 14,
Line 1, this equation should read as follows:

$$R^3 \text{ is } -\overset{\overset{\displaystyle O}{\|}}{C}-CH_3 \text{ or H.}$$

Signed and Sealed this

Fourth Day of November, 2003

JAMES E. ROGAN
*Director of the United States Patent and Trademark Office*